United States Patent [19]

Watanabe et al.

[11] Patent Number: 4,980,953

[45] Date of Patent: Jan. 1, 1991

[54] BINDING-UP BAND WITH LOCKING STRUCTURE

[75] Inventors: Kiyoharu Watanabe, Osaka; Minoru Fukuhara, Wakayama, both of Japan

[73] Assignees: Sumitomo Metal Industries, Ltd., Osaka; Kanpoo Steel Co., Ltd., Wakayama, both of Japan

[21] Appl. No.: 235,449

[22] Filed: Aug. 23, 1988

[30] Foreign Application Priority Data

Aug. 26, 1987 [JP] Japan ..... 62-213688

[51] Int. Cl.[5] ..... B65D 63/02

[52] U.S. Cl. ..... 24/20 EE; 24/20 R

[58] Field of Search ..... 24/20 EE, 23 EE, 20 R

[56] References Cited

U.S. PATENT DOCUMENTS

| | | | |
|---|---|---|---|
| 1,687,854 | 10/1928 | Anderson | 24/20 EE |
| 3,426,392 | 2/1969 | Timmerbeil | 24/20 EE |
| 4,226,007 | 10/1980 | Duenser | 24/20 EE |

FOREIGN PATENT DOCUMENTS

| | | | |
|---|---|---|---|
| 906318 | 3/1954 | Fed. Rep. of Germany | 24/20 EE |
| 3546021 | 6/1987 | Fed. Rep. of Germany | 24/20 EE |
| 1399609 | 4/1965 | France | 24/20 EE |
| 57-114457 | 7/1982 | Japan . | |
| 58-167049 | 11/1983 | Japan . | |
| 61-107759 | 7/1986 | Japan . | |
| 24929 | 10/1980 | United Kingdom | 24/20 EE |

*Primary Examiner*—Laurie K. Cranmer

*Attorney, Agent, or Firm*—Burns, Doane, Swecker & Mathis

[57] ABSTRACT

A binding-up band for use in fastening articles having remarkable shrink properties such as cotton or the like has at its ends locking structures which are adapted to fit one in the other in a complementary manner. In this locking structure, a plurality of raised engaging portions each having a wide portion and narrow portion are provided in a row in the longitudinal direction, and these raised engaging portions are formed by providing a sufficient number of pairs of symmetrical bent cuts in the band and pressing out these cut-provided portions to be of a trapezoid-like shape in longitudinal cross-section. Among the plurality of raised engaging portions, the raised engaging portions at the extreme ends of the engaging areas of the band are made longer than the intermediate raised engaging portions on the same areas, and the respective longer raised engaging portions are mutually fitted one in the other in a complementary manner and the intermediate raised engaging portions are also mutually fitted one in the other in a complementary manner. This construction enables yielding high displaceability relative to the deformation of the ends of the band due to the tensile force applied thereto, and a joint strength is obtainable which is substantially the same as that of the base metal, thus making it possible to prevent the raised engaging portions from being broken.

5 Claims, 5 Drawing Sheets

BINDING-UP BAND WITH LOCKING STRUCTURE

BACKGROUND OF THE INVENTION

1. Field of the Invention:

This invention relates to a binding-up band (a metal band) for use in fastening articles having remarkable shrink properties, such as cotton or the like, and more particularly to a binding-up band with locking structures in which the ends of the band are interconnected to each other by mutually fitting in projections formed on the ends thereof by providing cuts in the ends of the band and pressing out the cut-provided portions.

2. Statement of the Prior Art:

Broadly speaking, there are two ways of fastening articles utilizing a metal binding-up band manufactured of band steel: one is a way of fastening with seals (1); and the other a way of fastening without seals, that is, a seal-less fastening (2). A sealer is required when fastening is performed by means of the way of fastening with seals (1), while, in the way of seal-less fastening (2), fastening of the band is achieved by engaging means provided on the band itself, and no sealer is required in fastening the band. Thus, it is an advantage of the latter way that it enables a simple and quick bundling operation. Recently, this seal-less fastening way has been widely adopted.

It is common practice in the seal-less fastening method to fasten a band by mutually engaging locking portions provided on the ends thereof, and a locking structure disclosed in an Official Gazette of Japanese Patent Publication No. 39-13748 has been widely employed.

This widely employed locking structure adopts a method in which the ends of a band are overlapped and are detachably interconnected by means of irregular fitting of the ends thereof. FIGS. 13 and 14 show a concrete example of this method, in which pairs of symmetrical bent cuts are provided in the ends 11, 21 of the distal portions 1, 2 of a band, and the cut-provided portions are pressed out to form raised locking portions 101, 201 of the same length and each having a wide portion Wa and a narrow portion Wb for irregular fitting. When tensile force is applied to the band in a longitudinal direction (shown by the arrow A) in such a fitted condition, the wide portion Wa on the male end of the band and the narrow portion Wb on the female end thereof are caused to vertically overlap each other, whereby the ends of the band are interlocked.

This locking structure eases fastening and provides sufficient resistance to stretching. Therefore, the structure is well suited to bundling up articles having remarkable shrink properties such as cotton or the like.

However, this locking structure according to the prior art has a risk in that the locking portions at the extreme ends of the engaging area on the female end are subject to breakage since tensile force is applied thereto to a maximum extent when a tensile force is applied to the band in a longitudinal direction. When the band is broken, the locking state of the band is then released, the goods bundled thereby being caused to fly apart. It is very dangerous if this happens during a loading operation.

To cope with this, Sumitomo Metal Industries, Ltd. filed with the Japanese Patent Office on July 24, 1987 an application of the invention entitled, "Locking Structure for Binding-up Band" (Japanese patent application Nos. 62-185786 and 62-185787) in which loosening or breakage of the fastened portion of the band is protected.

SUMMARY OF THE INVENTION

An object of the present invention is to provide a binding-up band with locking structures in which the breakage of the raised engaging portions, which has been evident with the prior art, is prevented, and the strength of the end portions of the band, where especially greater resistance to stretching is required, is improved to such an extent that the strength of the joint portion is increased to as high as that of the base metal.

In a binding-up band according to the present invention, a plurality of pairs of symmetrical bent cuts are provided in the ends of the band in a row in the longitudinal direction, and the cut-provided portions are pressed out to form a trapezoid-like shape in longitudinal cross-section to form a given number of raised engaging portions each having thereon a wide portion and narrow portion. Among these plurality of raised engaging portions, the raised engaging portions at the extreme ends of the engaging areas of the band are made longer than those placed intermediate on the same areas, and the longer raised engaging portions at one end of the band are fitted in the corresponding longer portions on the other end, the intermediate raised engaging portions on both ends being also fitted in each other in the same manner.

Shortly, with the present invention, the raised engaging portions at the extreme ends of the engaging areas, where greater resistance to stretching is required, are formed so as to be longer than those placed intermediate, whereby the engagement strength of the relevant portions is improved to such an extent that the joint strength of the locking portions is substantially the same as that of the base metal as a whole, the breakage of the raised engaging portions on the female end thus being prevented.

Many other advantages, features and additional objects of the present invention will become apparent to those skilled in the art upon making reference to the detailed description and the accompanying drawings in which preferred structural embodiments incorporating the principles of the present invention are shown only by way of illustration.

DETAILED DESCRIPTION OF THE PREFERRED EMBODIMENTS

Figure 1:
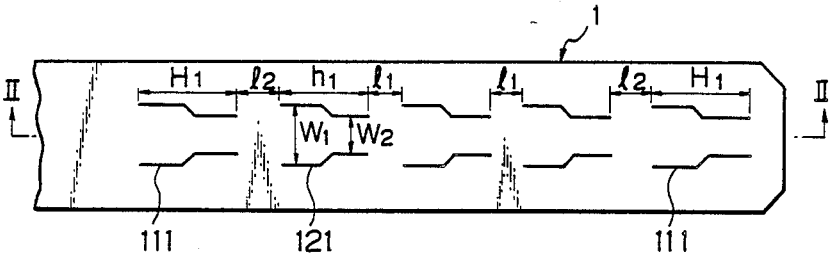
FIG. 1 is a plan view showing a state in which cuts are provided in the end of a band, which end acts as a female end, to form a preferred locking structure according to the present invention.
Figure 2:
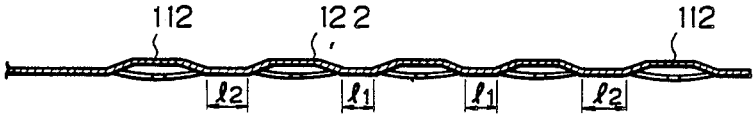
FIG. 2 is a longitudinal sectional view taken along the line II—II of FIG. 1.

The preferred embodiments according to the present invention will now be described in detail referring to the drawings.

In order to explain a preferred locking structure according to the present invention, FIGS. 1 through 4 show the ends of a band on which the preferred locking structures are provided. In this particular embodiment, five raised engaging portions are provided. The basic contour of the raised engaging portion realized under the present invention comprises a wide portion W1 and a narrow portion W2. These raised engaging portions are formed both on the female end 1 and male end 2 of the band by providing a sufficient number of pairs of bent cuts 111, 121, 211, 221 in the relevant portions in a row. Each cut can comprise one or more sections such as two parallel sections offset from each other and connected together by a rectilinearly extending intermediate section. In forming these raised engaging portions, it should be noted that the widths of the wide and narrow portions defined by the pair of bent cuts and the length of the bent cut are made slightly wider and longer on the female end than on the male end in view of the fact that the relevant portions on the female and male ends are interconnected by means of irregular fitting. The cut-provided portions are pressed out to form a trapezoid-like shape in longitudinal cross-section so as to form the raised engaging portions.

In the locking structure according to the present invention, among the five raised engaging portions formed on each of the female and male ends of the band, those formed at the extreme ends of the engaging area on each end are made longer than the others on the same end.

In other words, the length H1 of bent cuts 111, 211 provided to form raised engaging portions at the extreme ends of the engaging areas of the band is made longer than the other three bent cuts 121, 221, so that the raised locking portions 112, 212 at the extreme ends are longer than those intermediately formed engaging portions 122, 222. The length ratio of the raised engaging portions at the extreme ends of the engaging areas to those intermediate engaging portions preferably ranges from 1.1 to 1.3.

Although the raised engaging portions are evenly spaced in a normal case, in the locking structure according to the present invention, the distance 11 between each of the three intermediate raised engaging portions 122, 222 is made shorter in order to compensate for the provision of the longer raised engaging portions at the extreme ends of the engaging areas, the length of the whole engaging areas of the band thus being maintained substantially the same as that in the normal case (so as to maintain the yield of band substantially the same as that in the normal case). Due to this, the distance 12 between the raised engaging portions at the extreme ends of the engaging areas and the intermediate raised engaging portions adjacent thereto is caused to be slightly longer than the distance between each of the intermediate ones on the same areas. It is needless to say that these distances can be varied depending on how many raised engaging portions are formed and how they are sized.

Figure 3:
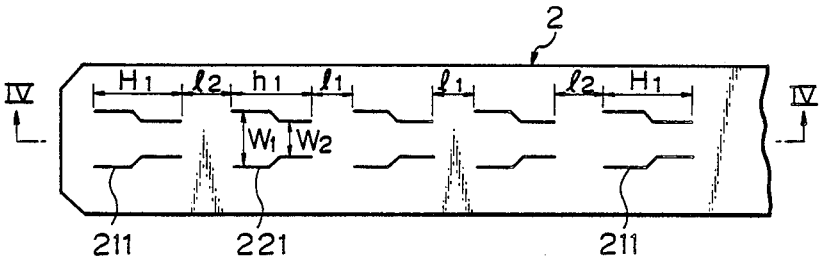
FIG. 3 is a plan view showing, as in FIG. 1, a state in which cuts are provided in the end of the band, which end acts as a male end.
Figure 4:
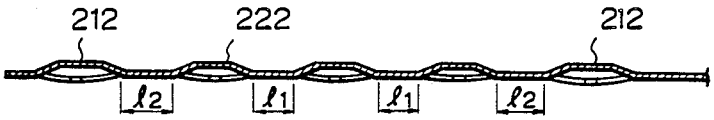
FIG. 4 is a longitudinal sectional view taken along the line IV—IV of FIG. 3.
Figure 5:
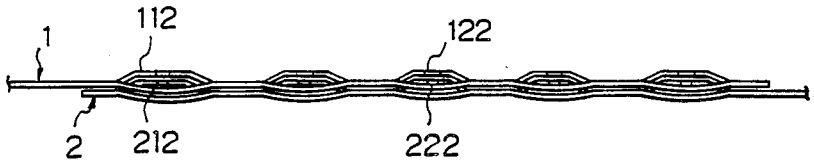
FIG. 5 is a front view showing a state in which the portions of the band shown in FIGS. 1 and 3 are overlapped.
Figure 6:
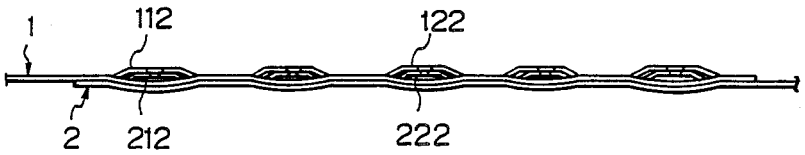
FIG. 6 is a front view showing a state in which the portions of the band shown in FIG. 5 are pressed together.

In the above described locking structure in which the raised engaging portions 111, 211 and 121, 221 in different lengths are formed to be of a trapezoid-like shape in longitudinal cross-section at the ends of the band, the band is fastened at the ends thereof by overlapping the ends of the female end 1 shown in FIG. 1 and the male end 2 thereof shown in FIG. 3 and pressing the overlapped portion for fitting the male portion, as shown in FIG. 6 in the female portion.

In other words, the engaging areas of these female and male ends are overlapped in such a manner that the intermediate raised engaging portions 122, 222 and the raised engaging portions 112, 212 at the extreme ends of the engaging areas on the respective ends are brought into an alignment relationship with each other. In this condition, it is possible to fit the raised engaging portions formed on the male end in the corresponding recesses formed on the back of the respective raised engaging portions formed on the female end when the wide portions W1 and narrow portions W2 thereof are overlapped, the fitting of the relevant portions thus being made possible.

In this way, the raised engaging portions 212, 222 on the male end are caused to press fit in the corresponding recesses formed on the back of the raised engaging portions formed on the female end, as shown in FIG. 6, when the relevant portions, 1, 2 of the band are pressed together.

Figure 7:
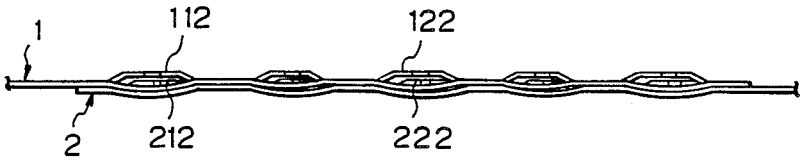
FIG. 7 is a front view showing a state in which the band shown in FIG. 6 is properly fastened by moving the ends of the band in opposite directions.
Figure 8:
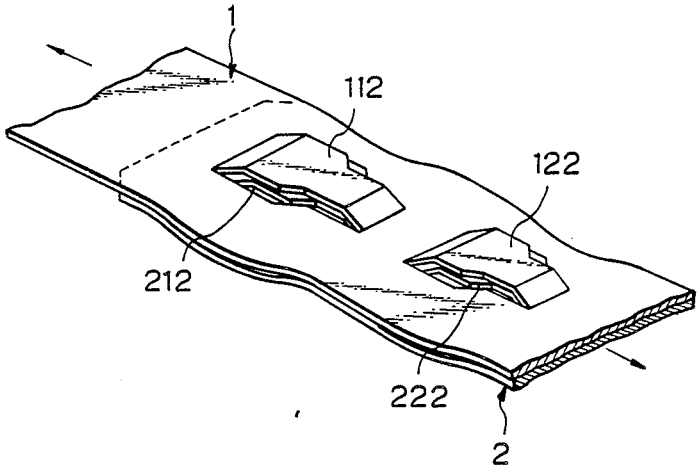
FIG. 8 is an enlarged perspective view of the engaged condition resulting at one end of the overlapped portion of the band when the band is properly fastened at that portion.

In this press-fitted condition, when tensile force is applied to the fastened portion in a longitudinal direction, the wide portions W1 of the raised engaging portions 212, 222 on the male end are caused to overlap the edges of openings formed in the female end by pressing out the narrow portions W2 to be locked there, as shown in FIGS. 7 and 8.

In a case where tensile force is applied to the fastened portion in a longitudinal direction, the raised engaging portions 112 at the extreme ends of the engaging area on the female end are subject to greater tensile force than the intermediate raised engaging portions 122 on the same end. However, in the present invention, the raised engaging portions at the extreme ends of the engaging areas are made longer than the intermediate ones on the same areas. This serves to increase the strength of the raised engaging portions at the extreme ends of the engaging areas above those of the intermediate ones on the same areas, whereby greater resistance to stretching is generated therein. As a result, joint strength which is substantially the same as that of the base metal can thus be obtained. Consequently, with the present invention, the possibility of the raised engaging portions 212 at the extreme ends of the engaging areas being broken is far smaller than in the case where the raised engaging portions are formed to have the same length.

Figure 9:
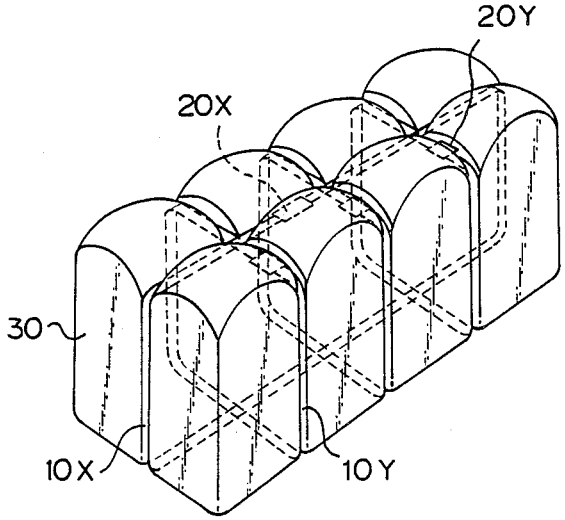
FIG. 9 is a perspective view showing a state in which a bundle of cotton is fastened with binding-up bands with locking structures according to the present invention.

FIG. 9 is a perspective view showing a state in which a bundle of cotton 30 is fastened utilizing binding-up bands with locking structures according to the present invention. The cotton is fastened by one binding-up band 10X placed therearound in the longitudinal direction and by three binding-up bands 10Y placed therearound in the transverse direction.

In bundling up the cotton, first of all, the cotton 30 is compressed, and the binding-up band 10X is then placed around the cotton 30 with the ends thereof being overlapped. Afterwards, the raised engaging portions 212, 222 on the male end are fitted in the recesses resulting from pressing out the raised engaging portions 112, 122 on the female end, the band being thus fastened there. It is preferred that the fastened portions 20X, 20Y not project from the surface of the bundle of cotton, and when they are placed on any of the surfaces other than the top surface thereof in the embodiment shown in FIG. 9, the fastened portions 20X, 20Y project therefrom. To avoid this, the fastened portions 20X, 20Y are arranged so as to be placed on the top surface of the bundle of cotton, where the fastened portions 20X, 20Y tend to sink in the expanding cotton. With this way of fastening, it is thus possible to avoid the possibility that the fastened portions are damaged during loading and/or transporting.

EXAMPLE 1

Figure 10:
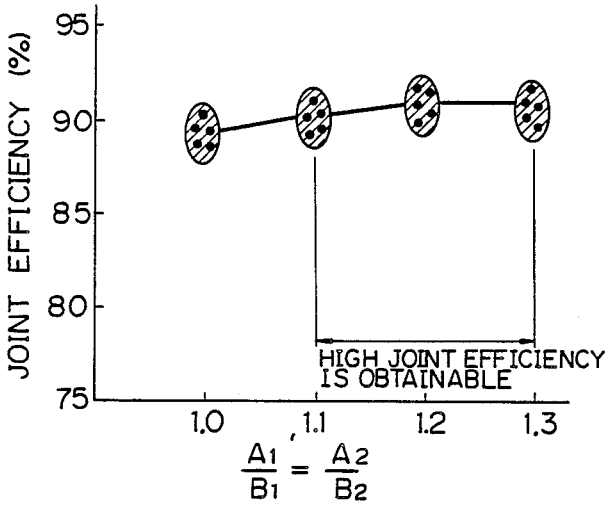
FIG. 10 is a graph showing the variation joint efficiency obtained with Example 1 of the present invention.

FIG. 10 shows the variation of joint efficiency of the fastened portion of a band of thickness 0.76 mm, width 19 mm and length 2,400 mm, which variation resulted from varying the length ratio of the raised engaging portions at the extreme ends of the engaging areas of the band to the intermediate raised engaging portions on the same areas and the distance between the respective raised engaging portions within the range of 100 mm from the ends of such a band.

Figure 12:
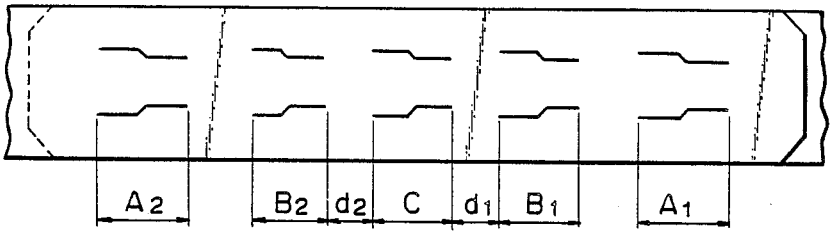
FIG. 12 is a diagram showing reference characteristics denoting the lengths of the relevant portions in each of the examples.
Figure 13:
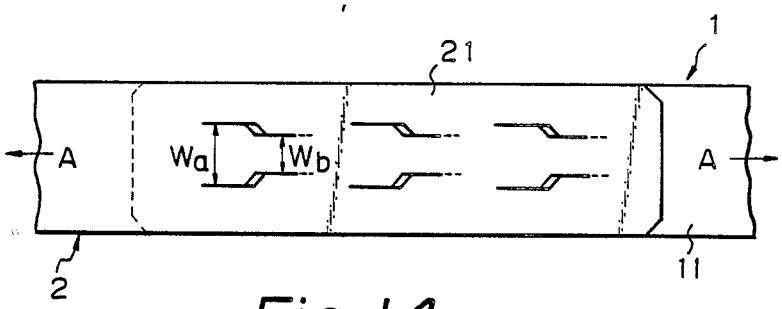
Fig. 13 PRIOR ART
FIG. 13 is a plan view showing a conventional sealless locking structure.
Figure 14:
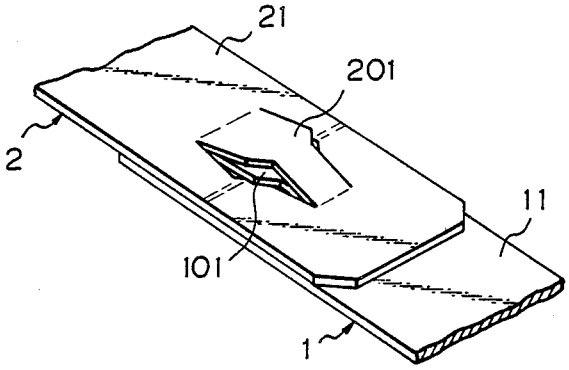
Fig. 14 PRIOR ART
FIG. 14 is an enlarged perspective view showing the same locking structure.

In this example, five raised engaging portions are provided on each end of the band. Itemized in Table 1 are dimensions of the relevant factors of this example, such as the lengths of the respective raised engaging portions, the distances between the intermediate raised engaging portions, and the length ratios of the raised engaging portions at the extreme ends of the engaging areas to the intermediate raised engaging portions, and reference characteristics denoting the relevant dimensions are shown in FIG. 12.

The variation of joint efficiency shown in FIG. 10 is the result obtained when a tensile force ranging from 135 to 150 kg/mm$^2$ was applied to the joint portion, and the joint efficiency was calculated from the following equation:

$$\text{Joint efficiency} = \frac{\text{Strength of the engaged portion}}{\text{Strength of the metal base}} \times 100$$

It is understood from what is shown in FIG. 10 that a higher joint efficiency can be obtained by making the raised engaging portions at the extreme ends of the engaging areas longer than the other raised engaging portions thereon as compared with the raised engaging portions of an equal length. In addition, it is seen in this example that a higher joint efficiency can be obtained when the length ratio of the raised engaging portions at the extreme ends of the engaging areas to the intermediate raised engaging portions on the same areas ranges from 1.1 to 1.3.

TABLE 1

| | | Lengths of the raised engaging portions (mm) | | | | | Distance between the intermediate engaging portions (mm) | | A1/B1 = |
|---|---|---|---|---|---|---|---|---|---|
| | | A1 | B1 | C | B2 | A2 | d1 | d2 | A2/B2 |
| Prior Art | 1 | 10 | 10 | 10 | 10 | 10 | 8 | 8 | 1.0 |
| Present | 2 | 11 | 10 | 10 | 10 | 11 | 7 | 7 | 1.1 |
| Invention | 3 | 12 | 10 | 10 | 10 | 12 | 6 | 6 | 1.2 |
| | 4 | 13 | 10 | 10 | 10 | 13 | 5 | 5 | 1.3 |

EXAMPLE 2

Figure 11:
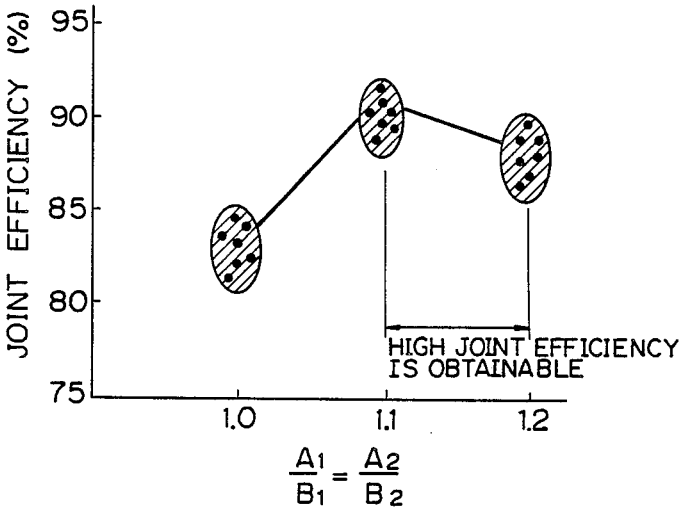
FIG. 11 is a graph showing the variation joint efficiency obtained with Example 2 of the present invention.

FIG. 11 shows the variation of joint efficiency of the fastened portion of a band of thickness 0.76 mm, width 19 mm and length 2,385 mm, which variation resulted from performing the same test as that performed with respect to Example 1, that is, varying the length ratio of the raised engaging portions at the extreme ends of the engaging areas to the intermediate raised engaging portions and the distance between the respective raised engaging portions within the range of 85 mm from the ends of the band.

Similarly to Example 1, five raised engaging portions are also provided on each end of the band in this example. Itemized in Table 2 are dimensions of the relevant factors of this example, such as the length of the respective raised engaging portions, the distances between the intermediate raised engaging portions, and the length ratio of the raised engaging portions at the extreme ends of the engaging areas to the intermediate raised engaging portions on the same areas.

It is seen from what is shown in FIG. 11 that a higher joint efficiency can be obtained by making the raised engaging portions at the extreme ends of the engaging areas longer as compared with the raised engaging portions of an equal length. In this example, a higher joint efficiency can be obtained when the length ratio of the raised engaging portions at the extreme ends of the engaging areas to the intermediate raised engaging portions on the same areas ranges from 1.1 to 1.2.

TABLE 2

| | | Lengths of the raised engaging portions (mm) | | | | | Distance between the intermediate engaging portions (mm) | | A1/B1 = |
|---|---|---|---|---|---|---|---|---|---|
| | | A1 | B1 | C | B2 | A2 | d1 | d2 | A2/B2 |
| Prior Art | 1 | 10 | 10 | 10 | 10 | 10 | 6 | 6 | 1.0 |
| Present | 2 | 11 | 10 | 10 | 10 | 11 | 5 | 5 | 1.1 |
| Invention | 3 | 12 | 10 | 10 | 10 | 12 | 4 | 4 | 1.2 |

As is described above, in the present invention, a plurality of raised engaging portions each having a wide portion and narrow portion are formed at the ends of a band by providing cuts therein and pressing out these cut-provided portions, and the raised engaging portions at the extreme ends of the engaging areas, which have to bear greater tensile force than the intermediate raised engaging portions, are made longer than the other raised engaging portions. This construction enables yielding high displaceability relative to deformation of the relevant portions due to the tensile force applied thereto, whereby a joint strength is obtainable which is substantially the same as that of the base metal. The present invention has an advantage in that the raised engaging portions can be prevented from being broken, and, in this sense, a binding-up band with locking structures according to the present invention is very safe in use.

While the present invention has been described with reference to the foregoing embodiments, various changes and modifications may be made thereto which fall within the scope of the appended claims.

What is claimed is:

1. A binding-up band with locking structures which adopts a method in which ends of said band are caused to overlap each other so that the ends of said band mutually fit together in a detachable manner, wherein a plurality of raised engaging portions each having a wide portion and narrow portion are provided in a row in the longitudinal direction, said raised engaging portions being formed by providing a sufficient number of pairs of symmetrical bent cuts in said band forming cut-provided portions and pressing out said cut provided portions to be of a trapezoid-like shape in longitudinal cross-section, among said plurality of raised engaging portions, the raised engaging portions at extreme ends of engaging areas of said band are made longer than intermediate raised engaging portions on the same areas, and said respective longer raised engaging portions are mutually fitted together in a complementary manner and said intermediate raised engaging portions are mutually fitted together in a complementary manner, the length ratio of said raised engaging portions at the extreme ends of the engaging areas of said band to said intermediate raised engaging portions on the same areas ranges from 1.1 to 1.3, all of said longer raised engaging portions and all of said intermediate raised engaging portions being simultaneously mutually fitted together in said complementary manner to lock said ends of said band together when said ends are overlapped, pressed together and moved in opposite directions facing away from each other in said longitudinal direction, said wide portion of each of said raised engaging portions at one of said ends overlapping said narrow portion of a respective one of said raised engaging portions at another one of said ends when said ends are locked together in said complementary manner.

2. A binding-up band with engaging portions which are engageable with each other for locking first and second sections of said band together, said band extending in a longitudinal direction and said first and second sections being spaced-apart in said longitudinal direction, said band comprising:

a plurality of said engaging portions arranged in a row at said first section of said band, said engaging portions being spaced-apart in said longitudinal direction and comprising portions of said band which are bent outwardly from said band, each of said engaging portions being defined by a pair of longitudinally extending cuts passing through said band, said engaging portions comprising at least a first engaging portion, a second engaging portion and a third engaging portion, said first and second engaging portions being adjacent to each other in said longitudinal direction and said second and third engaging portions being adjacent to each other in said longitudinal direction, a first distance between said first and second engaging portions being less than a second distance between said second and third engaging portions;

a plurality of said engaging portions arranged in a row at said second section of said band, said engaging portions being spaced-apart in said longitudinal direction and comprising portions of said band which are bent outwardly from said band, each of said engaging portions being defined by a pair of longitudinally extending cuts passing through said band, said engaging portions comprising at least a fourth engaging portion, a fifth engaging portion and a sixth engaging portion, said fourth and fifth engaging portions being adjacent to each other in said longitudinal direction and said fifth and sixth engaging portions being adjacent to each other in said longitudinal direction, a third distance between said fourth and fifth engaging portions being less than a fourth distance between said fifth and sixth engaging portions; and said engaging portions at said first section of said band being engageable with said engaging portions at said second section of said band for locking said first and second sections together when said first and second sections are overlapped, pressed together and moved in opposite directions facing away from each other in said longitudinal direction;

said first, second and third engaging portions simultaneously engaging and pressing out portions of said fourth, fifth and sixth engaging portions, respectively, to lock said first and second sections of said band together when said first and second sections are overlapped, pressed together and moved in opposite directions facing away from each other in said longitudinal direction.

3. A binding-up band with engaging portions which are engageable with each other for locking first and second sections of said band together, said band extending in a longitudinal direction and said first and second sections being spaced-apart in said longitudinal direction, said band comprising:

a plurality of said engaging portions arranged in a row at said first section of said band, said engaging portions being spaced-apart in said longitudinal direction and comprising portions of said band which are bent outwardly from said band, each of said engaging portions being defined by a pair of longitudinally extending cuts passing through said band, said engaging portions comprising at least a first engaging portion, a second engaging portion and a third engaging portion, said first and second engaging portions being adjacent to each other in said longitudinal direction and said second and third engaging portions being adjacent to each other in said longitudinal direction, a first distance between said first and second engaging portions being less than a second distance between said second and third engaging portions;

a plurality of said engaging portions arranged in a row at said second section of said band, said engaging portions being spaced-apart in said longitudinal direction and comprising portions of said band which are bent outwardly from said band, each of said engaging portions being defined by a pair of longitudinally extending cuts passing through said band, said engaging portions comprising at least a fourth engaging portion, a fifth engaging portion and a sixth engaging portion, said fourth and fifth engaging portions being adjacent to each other in said longitudinal direction and said fifth and sixth engaging portions being adjacent to each other in said longitudinal direction, a third distance between said fourth and fifth engaging portions being less than a fourth distance between said fifth and sixth engaging portions; and said engaging portions at said first section of said band being engageable with said engaging portions at said second section of said band for locking said first and second sections together when said first and second sections are overlapped, pressed together and moved in opposite directions facing away from each other in said longitudinal direction;

each of said engaging portions comprising first and second longitudinally spaced-apart portions, said first portion having a width in a transverse direction which is greater than a width in said transverse direction of said second portion, said band including first and second spaced-apart free ends and said second portion of each of said engaging portions at said first section of said band being located closer to said first free end of said band than said first portion thereof and said first portion of each of said engaging portions at said second section of said band being located closer to said second free end of said band than said second portion thereof.

4. A binding-up band with engaging portions which are engageable with each other for locking first and second sections of said band together, said band extending in a longitudinal direction and said first and second sections being spaced-apart in said longitudinal direction, said band comprising:

a plurality of said engaging portions arranged in a row at said first section of said band, said engaging portions being identically shaped, spaced-apart in said longitudinal direction and comprising portions of said band which are bent outwardly from said band, each of said engaging portions being defined by a pair of longitudinally extending cuts passing through said band, said engaging portions comprising at least a first engaging portion and a second engaging portion, said first engaging portion having a length $H_1$ in said longitudinal direction which is greater than a length $H_2$ in said longitudinal direction of said second engaging portion;

a plurality of said engaging portions arranged in a row at said second section of said band, said engaging portions being identically shaped, spaced-apart in said longitudinal direction and comprising portions of said band which are bent outwardly from said band, each of said engaging portions being defined by a pair of longitudinally extending cuts passing through said band, said engaging portions comprising at least a third engaging portion and a fourth engaging portion, said third engaging portion having a length $H_1$ in said longitudinal direction which is greater than a length $H_2$ in said longitudinal direction of said fourth engaging portion; and said engaging portions at said first section of said band being engageable with said engaging portions at said second section of said band for locking said first and second sections together when said first and second sections are overlapped, pressed together and moved in opposite directions facing away from each other in said longitudinal direction;

said first and second engaging portions simultaneously engaging and pressing out portions of said third and fourth engaging portions, respectively, to lock said first and second sections of said band together when said first and second sections are overlapped, pressed together and moved in opposite directions facing away from each other in said longitudinal direction.

5. A binding-up band with engaging portions which are engageable with each other for locking first and second sections of said band together, said band extending in a longitudinal direction and said first and second sections being spaced-apart in said longitudinal direction, said band comprising:

a plurality of said engaging portions arranged in a row at said first section of said band, said engaging portions being identically shaped, spaced-apart in said longitudinal direction and comprising portions of said band which are bent outwardly from said band, each of said engaging portions being defined by a pair of longitudinally extending cuts passing through said band, said engaging portions comprising at least a first engaging portion and a second engaging portion, said first engaging portion having a length $H_1$ in said longitudinal direction which is greater than a length $H_2$ in said longitudinal direction of said second engaging portion;

a plurality of said engaging portions arranged in a row at said second section of said band, said engaging portions being identically shaped, spaced-apart in said longitudinal direction and comprising portions of said band which are bent outwardly from said band, each of said engaging portions being defined by a pair of longitudinally extending cuts passing through said band, said engaging portions comprising at least a third engaging portion and a fourth engaging portion, said third engaging portion having a length $H_1$ in said longitudinal direction which is greater than a length $H_2$ in said longitudinal direction of said fourth engaging portion; and said engaging portions at said first section of said band being engageable with said engaging portions at said second section of said band for locking said first and second sections together when said first and second sections are overlapped, pressed together and moved in opposite directions facing away from each other in said longitudinal direction;

each of said engaging portions comprising first and second longitudinally spaced-apart portions, said first portion having a width in a transverse direction which is greater than a width in said transverse direction of said second portion;

said band including first and second spaced-apart free ends and said second portion of each of said engaging portions at said first section of the band being located closer to said first free end of said band than said first portion thereof and said first portion of each of said engaging portions at said second section of said band being located closer to said second free end of said band than said second portion thereof.

* * * * *